US005387770A

United States Patent [19]

Ikehata et al.

[11] Patent Number: 5,387,770

[45] Date of Patent: Feb. 7, 1995

[54] ELECTRIC OPERATING DEVICE FOR CIRCUIT BREAKER

[75] Inventors: Youji Ikehata; Shinji Yokota, both of Hiroshima, Japan

[73] Assignee: Mitsubishi Denki Kabushiki Kaisha, Tokyo, Japan

[21] Appl. No.: 70,192

[22] Filed: Jun. 2, 1993

[30] Foreign Application Priority Data

Jun. 2, 1992 [JP] Japan ..... 4-141250
Jun. 2, 1992 [JP] Japan ..... 4-141251
May 6, 1993 [JP] Japan ..... 5-105524

[51] Int. Cl.[6] ..... H01H 3/00
[52] U.S. Cl. ..... 200/17 R; 200/573
[58] Field of Search ..... 200/17 R, 18, 144 R, 200/144 B, 19 A, 31 A, 330, 318-323, 400, 501, 573, 574; 335/166, 167, 171, 172, 185, 186, 189, 190

[56] References Cited

U.S. PATENT DOCUMENTS 4,916,422 4/1990 Ikehata et al. ..... 335/190

FOREIGN PATENT DOCUMENTS 0427641 5/1991 European Pat. Off. ..... H01H 71/70
2101029 3/1972 France ..... H01H 71/00
4-6727 1/1992 Japan ..... H01H 75/00

OTHER PUBLICATIONS

*Patent Abstracts of Japan,* vol. 16, No. 150 (E-1189), Apr. 14, 1992.

*Primary Examiner*—A. D. Pellinen
*Assistant Examiner*—Michael A. Friedhofer
*Attorney, Agent, or Firm*—Burns, Doane, Swecker & Mathis

[57] ABSTRACT

An electric operating device for a circuit breaker includes a cam which is turned in a predetermined direction by an electric motor which rotates in response to operating signals, and a slider having cam engaging portions which make engagement and disengagement every half revolution of the cam, and an opening into which the handle of the circuit breaker is inserted, the slider being slidable in the directions of the "on" and "off" operations of the handle. In the device, in response to the "on" and "off" operations, the cam engaging portions of the slider are disengaged from the cam, respectively. With the device, the tripping of the circuit breaker handle can be displayed without an intricate mechanism nor an additional space.

6 Claims, 17 Drawing Sheets

ELECTRIC OPERATING DEVICE FOR CIRCUIT BREAKER

BACKGROUND OF THE INVENTION

1. Field of the Invention

This invention relates to an electric operating device for actuating a handle of a circuit breaker electrically.

2. Description of the Related Art

A conventional electric operating device for a circuit breaker will be described with reference to FIGS. 19(*a*) through 23, which is disclosed in Published Unexamined Japanese Patent Application No. Hei-4-6727 for instance. FIGS. 19(*a*) through 19(*d*) are perspective views of the conventional device, FIG. 20 is a sectional view showing the conventional device, FIG. 21 is an enlarged perspective view showing an operating member and a moving piece in the conventional device, FIG. 22 is an explanatory diagram for a description of the operation of the operating member, and FIG. 23 is a circuit diagram showing the control circuit of a drive section.

More specifically, FIG. 19(*a*) shows a state of the electric operating device in which an operating part 20 of an operating member 2 is disengaged from a handle 4. That is, the operating part 20 of the operating member 2 is manually pushed toward a body 1 of the device to move a hole 34 formed in the operating member 2 towards a protrusion 33 thereby to disengage the operating part 20 from the handle 4 (See FIG. 21). When the electric operating device is in this state, the handle 4 can be operated manually, and a power switch 25 (FIG. 23) has been turned off by the operating member 2, so that a drive section 13 (FIG. 23) is not operated even if a remote signal is issued.

FIG. 19(*b*) shows another state of the electric operating device that the operating member 2 is pulled out in the direction of an arrow shown therein, and the handle 4 is at the "off" position where the operating member 2 engages with the handle 4 which is held in the space formed in the operating part 20 as shown in FIG. 22(*a*). In this state, the operating member 2 is away from the power switch 25, and therefore current is applied to a control circuit shown in FIG. 23, so as to make the drive section 13 operative.

When a remote "on" switch 35 is closed, a remote signal is applied to the control circuit of the drive section 13, to set the handle 4 at the "on" position. As a result, an electric motor 15 is rotated in the direction of the arrow R shown in FIG. 20, so that the protrusion 33 of the moving body 17 is moved through a threaded shaft 16 and a driven body 21 in the direction of the arrow X; that is, the operating member 2 is moved through the hole 34 in the same direction, so that the handle 4 is set at the "on" position by the operating part 20 as shown in FIG. 19(*c*) and FIG. 22(*b*). At the same time, a position detecting switch 27 is held depressed by a switching operating part 26. Hence, the motor 15 is rotated in the opposite direction, and the moving body 17 is therefore moved in the reverse direction, and accordingly the operating member 2 is also moved in the opposite direction. The operating member 2 is stopped when the switch operating part 26 abuts against another position detecting switch 28, as shown in FIG. 22(*c*) (cf. the curved arrow in FIG. 19(*c*)). In this case, the distance between the positions of the moving member 2 in FIGS. 22(*b*) and 22(*c*) is set equal to the range of movement between the "on" position of the handle 4 and a trip display position. The operating part 20 of the operating member 2 has a width corresponding to the distance between the "on" position of the handle 4 and the trip display position, and therefore the handle 4 will not be pushed towards the "off" position.

Since the handle 4 is at the "on" position, the circuit breaker 3 is turned on, thus allowing an electric current to flow in an electric circuit connected thereto. If overcurrent flows in the electric circuit, the circuit breaker 3 trips, so that the handle 4 is moved from the "on" position to the trip display position. In this case, the handle 4 is moved inside the operating part 20 as indicated by the arrow in FIG. 19(*d*) or as indicated by the phantom line in FIG. 22(*c*); however, the operating member 22 is not moved. The circuit breaker thus tripped can be reset by moving the handle 4 to the "off" position.

In order to move the handle 4 from the "on" position to the "off" position, or to reset the same, a remote "off" switch 36 is closed, (FIG. 23) so that the motor 15 is rotated in the direction of the arrow S to thereby move the driven body 21 and the operating member 2 in the direction of the arrow Y; that is, the handle 4 is moved to the "off" position as shown in FIG. 22(*d*). In this operation, the driven body 21 abuts against another position detecting switch 30, (FIG. 23) and moves in the opposite direction. As the driven body moves on, the switch operating part 26 depresses another position detecting switch 29 before the position where the on-operation of the handle 4 is effected, so that the motor 15 is stopped, and the operating member 2 is stopped as shown in FIG. 22(*e*) which is of the same as FIG. 22(*a*).

With such a conventional electric operating device as described above, in order to display the tripping of the circuit breaker 3, the operating part including the operating handle 4 requires a space larger than the allowable length from the "on" position to the trip display position, and, after having achieved the "on" operation, the operating handle 4 must be returned a distance equal to the allowable length.

Hence, the conventional electric operating device suffers from the following difficulties:

(1) Since, after having achieved the "on" operation, the operating part must be returned the distance equal to the allowable length as was described above, the position of the operating part must be controlled with high accuracy, and the control circuit is unavoidably intricate.

(2) Since it is necessary to move the operating part additionally as much as the distance equal to the allowable length, additional spaces must be provided for the operating part in the directions of "on" and "off" operations.

SUMMARY OF THE INVENTION

Accordingly, an object of the present invention is to eliminate the above-described difficulties accompanying a conventional electric operating device for a circuit breaker.

More specifically, an object of the invention is to provide an electric operating device for a circuit breaker which is simple in arrangement, and which is able to display the tripping of the circuit breaker handle without provision of an additional space.

Another object of the invention is to provide an electric operating device for a circuit breaker which is able to reset the tripped circuit breaker by an "off" operation whenever the circuit breaker is tripped after it has been placed in "on" state or in "off" state.

Accordingly to the present invention, the above, and other objects of the present invention are met by the provision of an electric operating device for a circuit breaker, which includes a cam which is turned in a predetermined direction by an electric motor which is driven by operating signals, a slider having cam engaging portions which make engagement and disengagement every half revolution of the cam, and an opening into which the handle of the circuit breaker is inserted, the slider being slidable in the directions of the "on" and "off" operations of the handle. After the "on" and "off" operations of the handle, the cam engaging portions of the slider is disengaged from the cam, respectively.

In the device, after the "on" or "off" operation, the cam engaging portions of the cam are disengaged from the cam, respectively. Accordingly, the slider, being free from the cam, is moved to the "on", "off" and "trip" positions selectively in association with the movement of the circuit breaker handle. Therefore, the tripping of the circuit breaker can be displayed by using the "trip" position.

In the device, a manual lever operated by a manual operating lever may be engaged with the slider. In this case, the slider being free from the cam is manually operated resulting in reducing the operating load as much.

The device is further provided with a motor control circuit for driving the electric motor, the motor control circuit including a position detecting switch for the cam and a position detecting switch for the slider, each of which is a three-way switch.

In the device having the motor control circuit, when the "on" and "off" positions of the cam are not in a predetermined relation with the "on", "off" and "trip" positions of the slider, the motor is operated to allow the cam to idle thereby correcting the positional relation. Hence, whether the circuit breaker is in "on" state, or in "off" state before tripped, it can be reset by an external "off" operation signal.

BRIEF DESCRIPTION OF THE DRAWINGS

The accompanying drawings, which are incorporated in and constitute an part of the specification, illustrated presently preferred embodiments of the invention and, together with the general description given above and the detailed description of the preferred embodiments given below, serve to explain the principles of the invention. In the accompanying drawings.

DETAILED DESCRIPTION OF THE INVENTION

Figure 1:
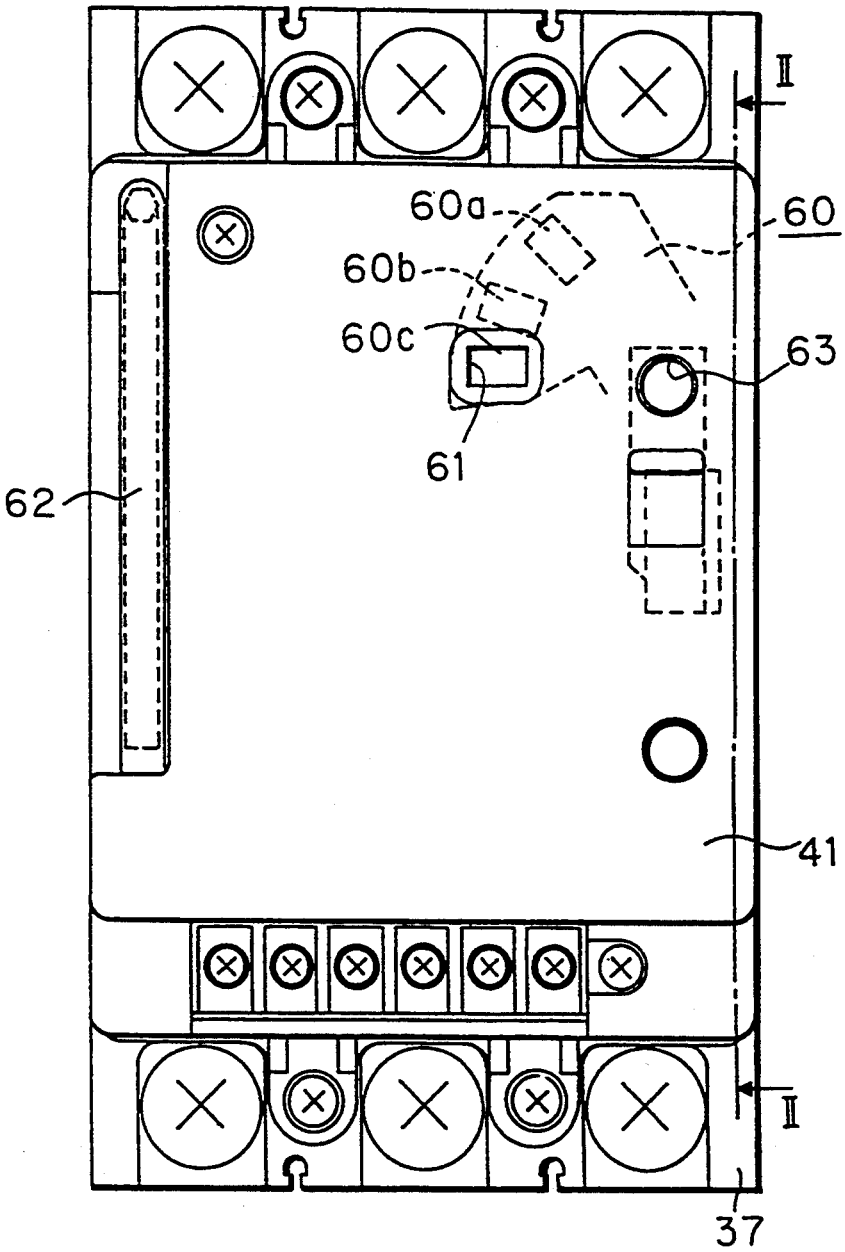
FIG. 1 is a schematic diagram illustrating a front view of an electric operating device for a circuit breaker, which constitutes an embodiment of the invention.
Figure 2:
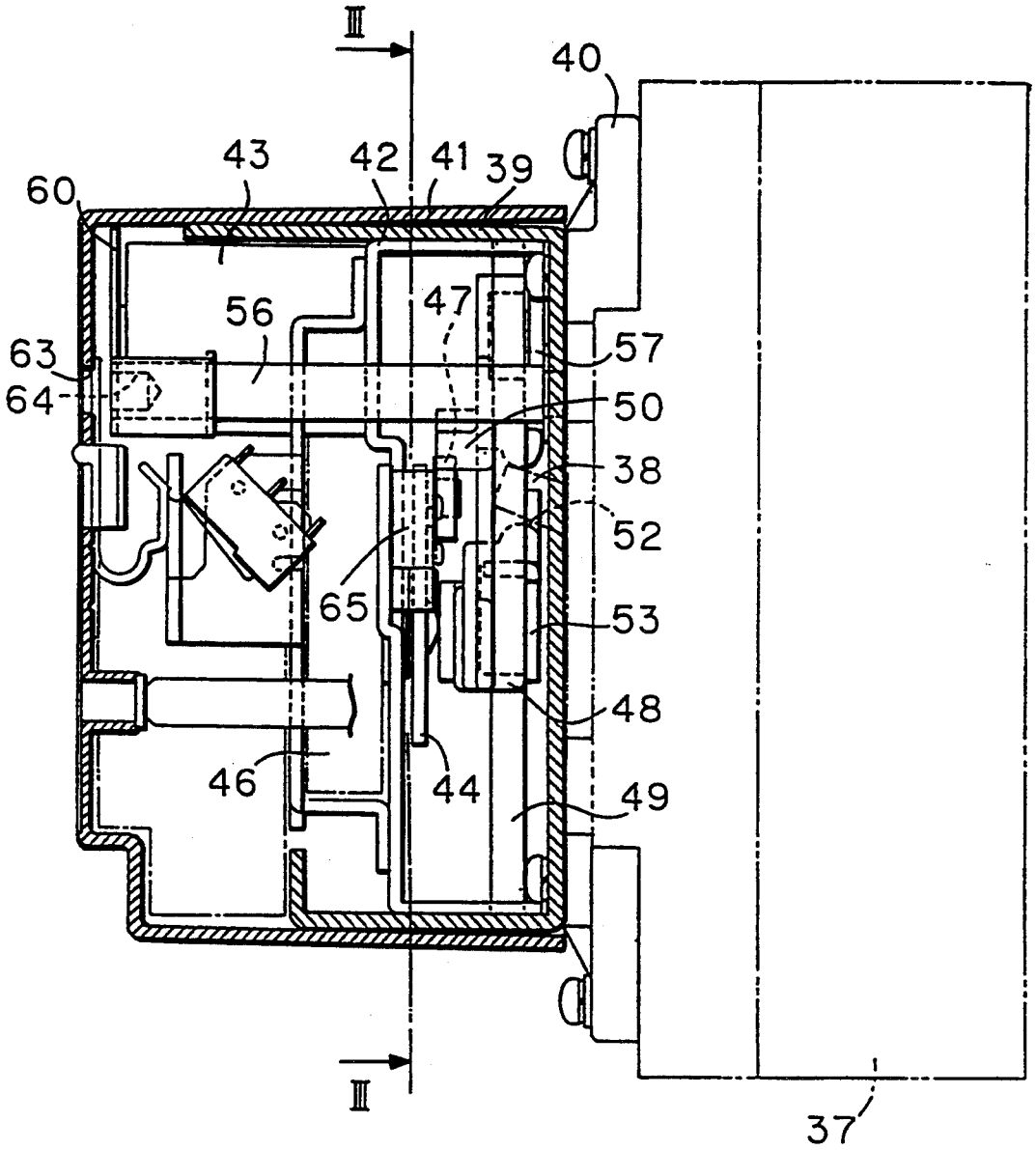
FIG. 2 is a schematic diagram illustrating a right side view of the embodiment shown in FIG. 1.

Preferred embodiments of this invention will be described with reference to the accompanying drawings.

An electric operating device for a circuit breaker, a first embodiment of this invention (corresponding to claim 1), will be described with reference to FIGS. 1 through 15.

In those figures, reference numeral 37 designates a circuit breaker; 38, the handle of the circuit breaker 37; 39, a device frame mounted through a mounting stand 40 on the circuit breaker 37; 41, a device cover fixedly mounted on the device frame 39 covering the latter; 42, a supporter provided in the device frame 39; 43, an electric motor mounted on the supporter 42; 44, a cam supported through a cam shaft 45 on the supporter 42 in such a manner that it is turned in a predetermined direction through a gear section 46 by the motor 43; 47, a cam roller provided for the cam 44; and 48, a slider. The slider 48 is slidably supported by guide rods 49, and reciprocated by the cam 44 in the directions of "on" and "off" operations of the handle 38. The slider 48 is formed by molding a low frictional coefficient material.

Further in those figures, reference numerals 50 and 51 designate an "on" -operation-side cam engaging portion and an "off"-operation-side cam engaging portion, respectively, which are protruded from the slider 48 with which portions the cam roller 47 is brought into and out of engagement; 52, an opening formed in the slider 48 into which the handle 38 is inserted; 53, a reset lever rotatably mounted on a pin 54 embedded in the cam engaging portion 51; 55, a compression spring urging the reset lever 53 at all times; 56, a manual operating shaft rotatably held by the device frame 39 and the supporter 42; 57, a manual lever secured to the lower end portion of the manual operating shaft 56, and having a roller 58 at the other end which is engaged with a recess 59 formed in the slider 48; 60, a display board secured to the upper end portion of the manual operating shaft 56, having an "off" display part 60*a*, a "trip" display part 60*b*, and an "on" display part 60*c*; 61, a display window formed in the device cover 41; 62, a manual operating handle detachably mounted on the device cover 41; 63, a hole formed in the device cover 41 into which the manual operating handle 62 is inserted; 64, an engaging hole formed in the top end portion of the manual operating shaft 56 into which the manual operating handle 62 is fitted; 65, a position detecting switch for the cam 44; and 66, a position detecting switch for the slider 48.

The position detecting switches 65 and 66 are three-way switches.

The operation of the embodiment thus organized will be described.

Figure 3:
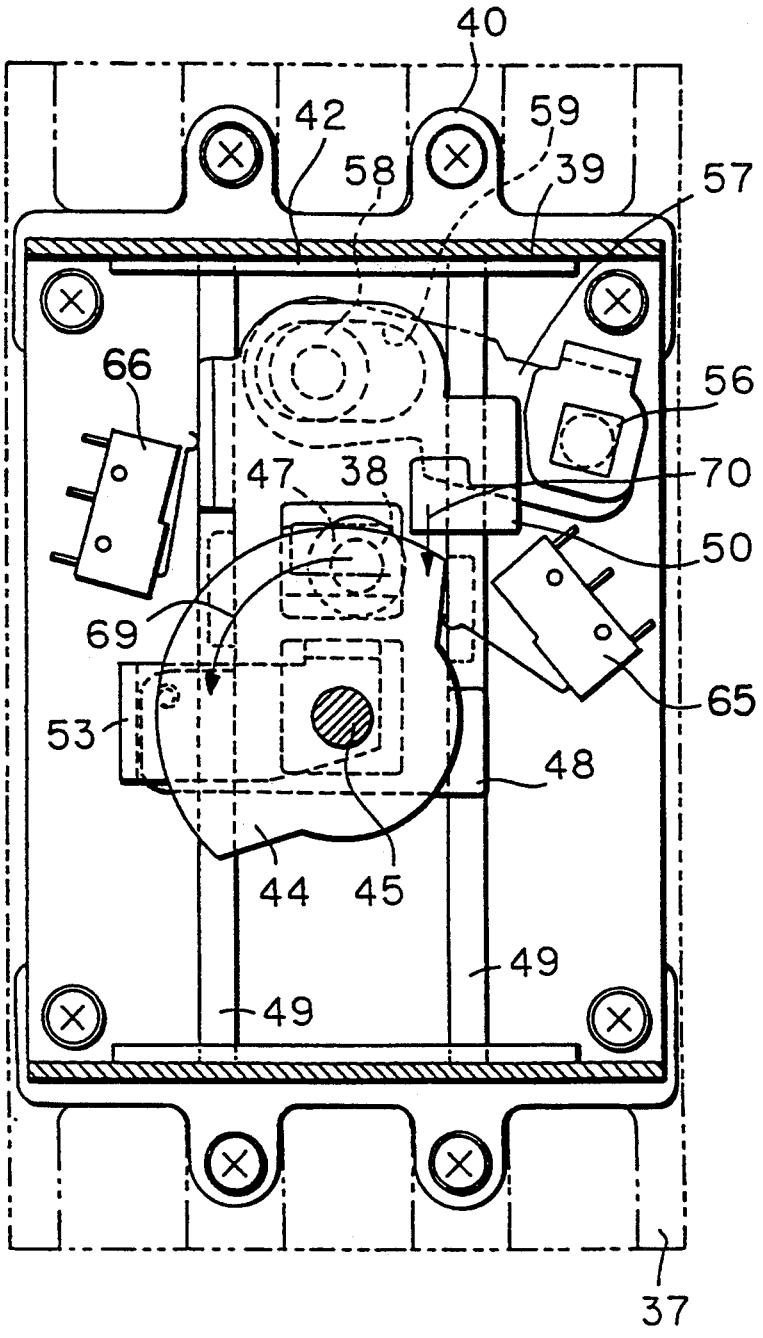
FIG. 3 is a schematic diagram showing a sectional view taken along a line III—III shown in FIG. 2 with a device cover removed.
Figure 4:
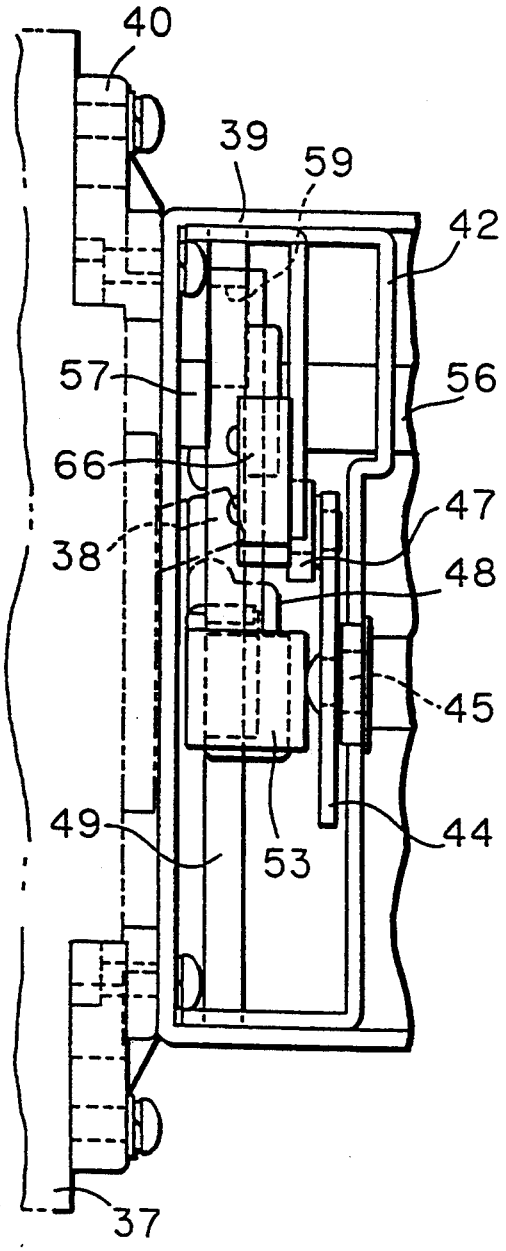
FIG. 4 is a schematic diagram illustrating a left side view of the embodiment shown in FIG. 3.
Figure 5:
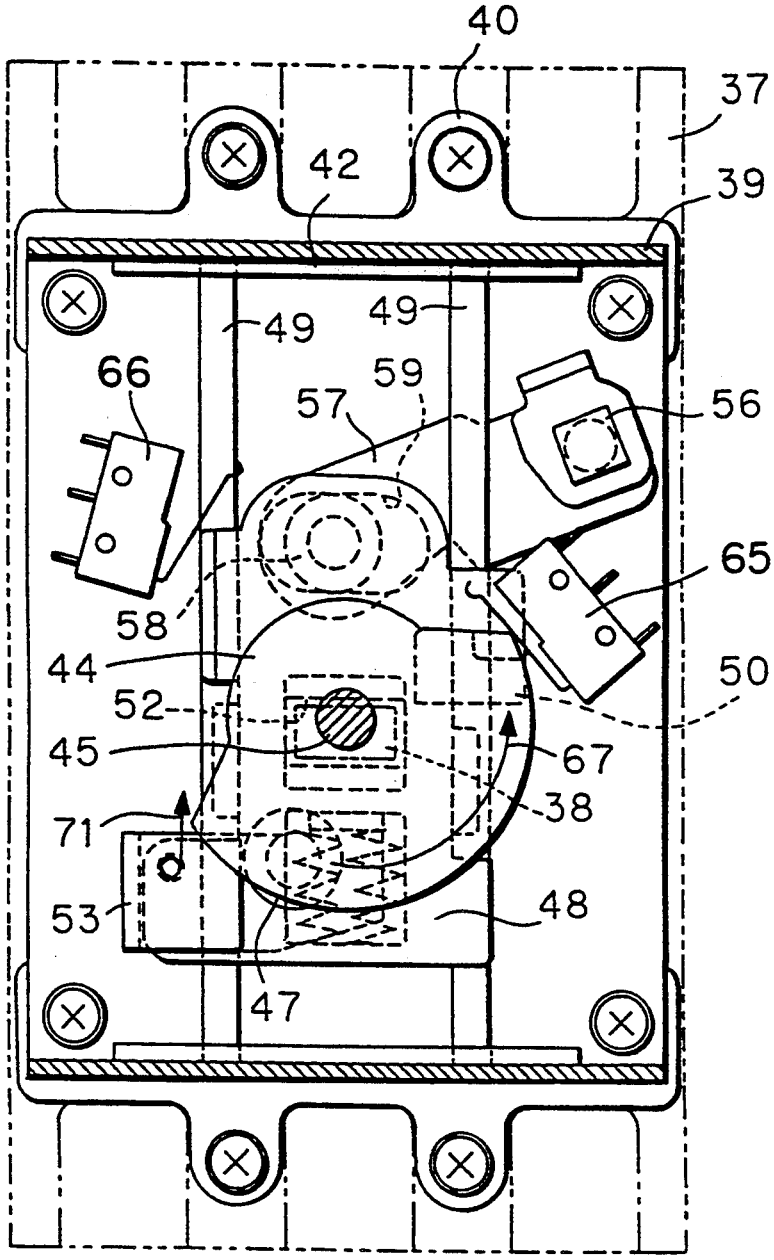
FIG. 5 is a schematic diagram illustrating a sectional view corresponding to FIG. 3, showing a state of the device when the circuit breaker is in "off" state.
Figure 6:
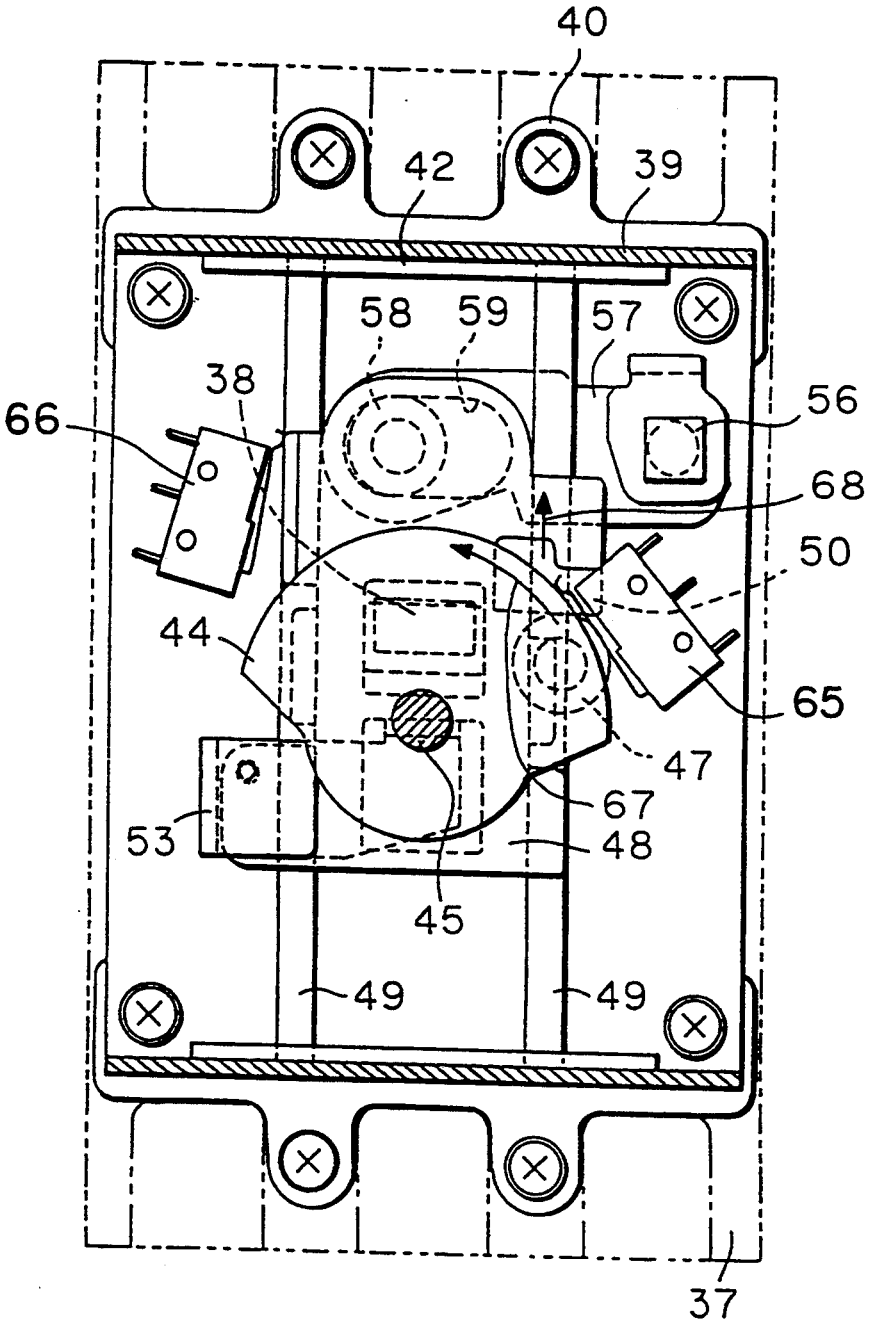
FIG. 6 is a schematic diagram illustrating a sectional view corresponding to FIG. 3, showing a state of the device when the circuit breaker in "off" state is going to be placed in "on" state.

FIG. 5 shows the circuit breaker 37 which is in "off" state. When, under this condition, an "on" operation is effected, the motor 43 is driven to turn the cam 44 by 180° in the direction of an arrow 67. In this connection, it should be noted that a micro-switch detects the rotation of the cam 44, and stops the latter 44 every detection of the rotation of 180° of the cam. While the cam 44 is being swung 180°, as shown in FIG. 6 the cam roller 47 pushes the "on" operation cam engaging portion 50 in the direction of the arrow 68. Therefore, with the cam 44 stopped at the "on" position as shown in FIG. 3, the slider 48 is moved in the direction of the "on" operation of the handle 38, so that the circuit breaker 37 is placed in "on" state as shown in FIGS. 1 through 4. In this operation, as the slider 48 moves, the manual lever 57 is turned clockwise, and therefore the manual operating shaft 56 is also turned to swing the display board 60 clockwise. As a result, the "on" display part 60*c* appears in the display window 61 as shown in FIG. 1.

When, in the case where the circuit breaker 37 is in "on" state as shown in FIG. 3, an "off" operation is effected, the motor 43 is driven to turn the cam 44 by 180° in the direction of the arrow 69. While the cam is being swung 180°, the cam roller 47 pushes the "off" operation cam engaging portion 51 (i.e., the reset lever 53). Therefore, with the cam 44 stopped at the "off" position as shown in FIG. 5, the slider 48 is moved in the direction of the "off" operation of the handle 38, so that the circuit breaker 37 is placed in "off" state. In this operation, as the slider 48 moves, the manual lever 57 is turned counterclockwise, and therefore the manual operating shaft 56 is also turned to cause the "off" display part 60*a* to appear in the display window 61.

Figure 7:
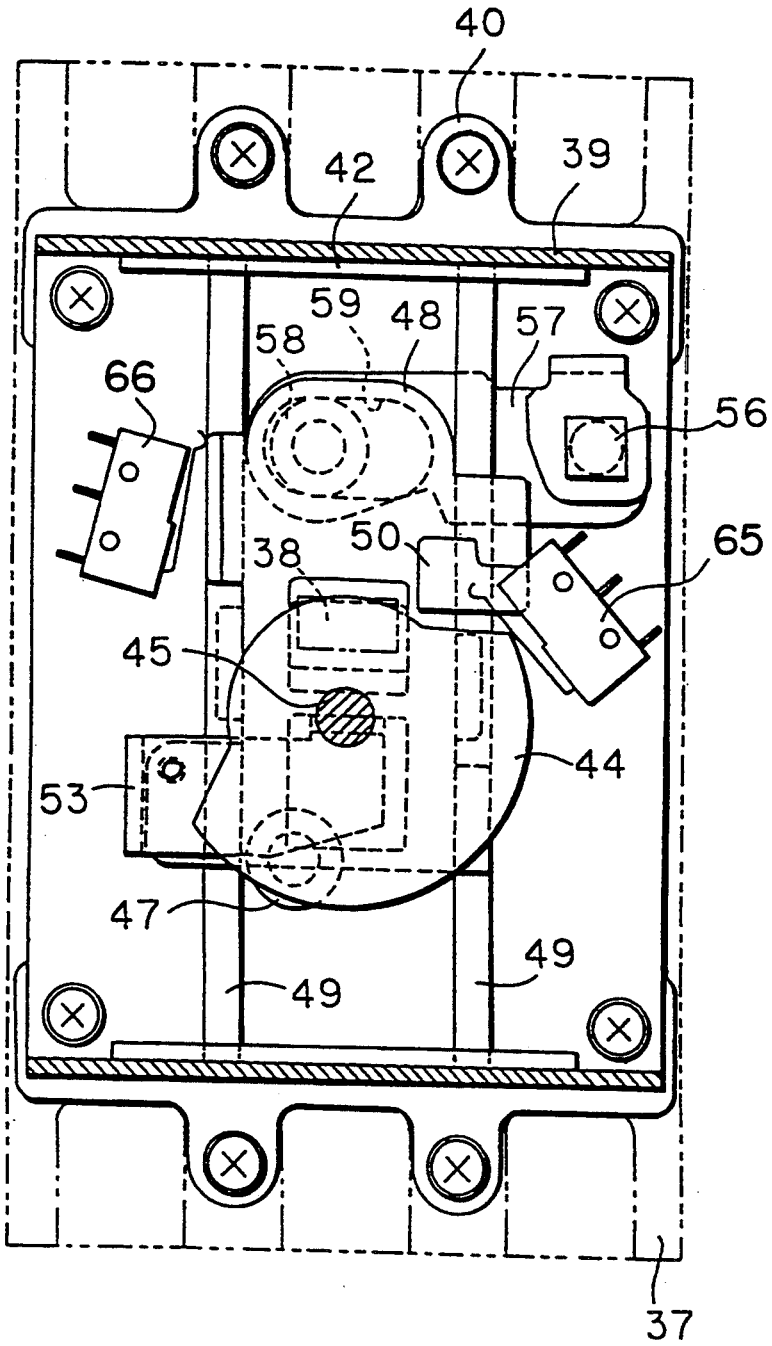
FIG. 7 is a schematic diagram illustrating a sectional view corresponding to FIG. 3, showing a state of the device when the circuit breaker in "off" state is tripped.
Figure 8:
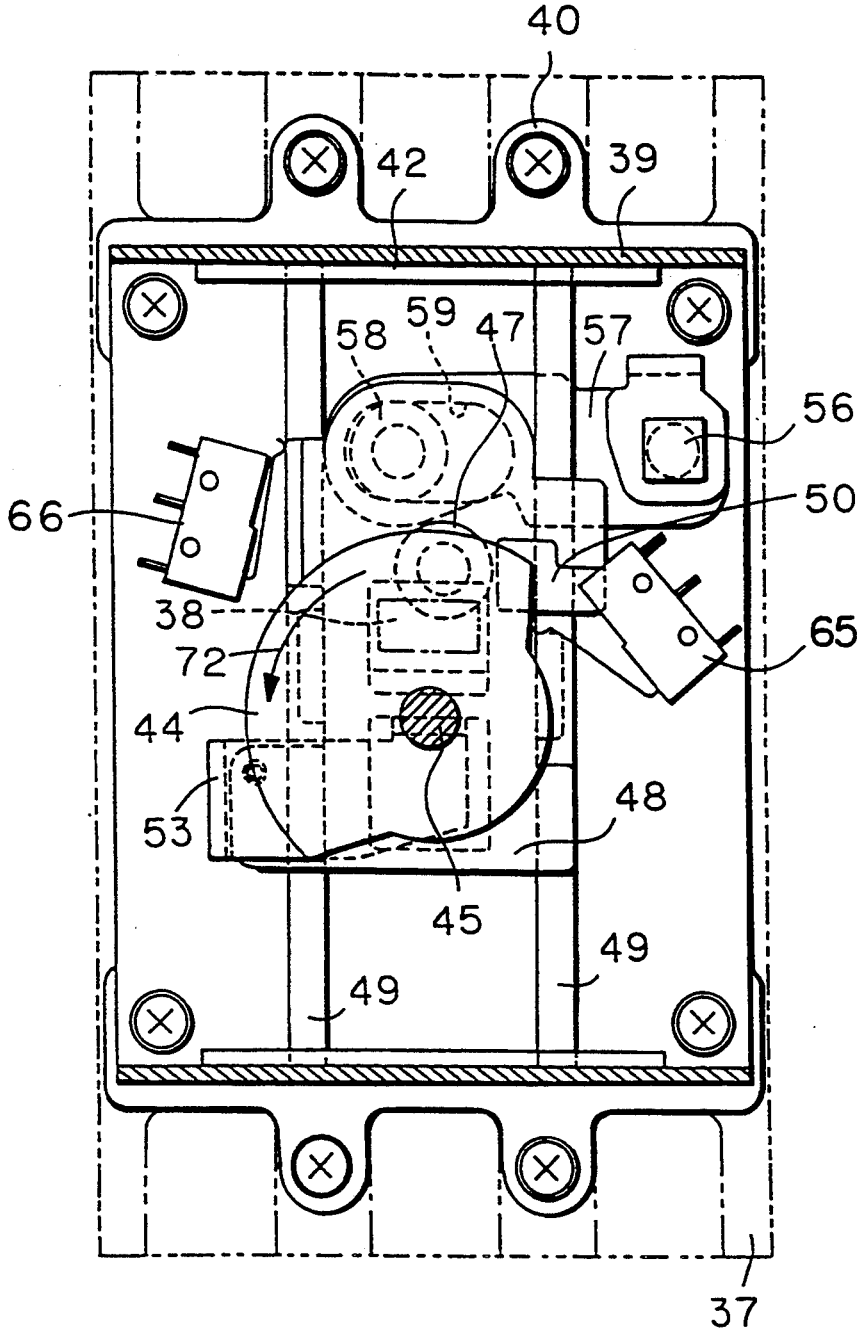
FIG. 8 is a schematic diagram illustrating a sectional view corresponding to FIG. 3, showing a state of the device when the circuit breaker in "on" state is tripped.

Either when the circuit breaker 37 is in "on" state as shown in FIG. 3, or when it is in "off" state as shown in FIG. 5, the cam engaging portions 50 and 51 of the slider 48 are away from the cam roller 47. Accordingly, when the circuit breaker 37 is tripped in this state, the slider 48, being free from the cam 44, operates in association with the movement of the handle 38, so that, when the circuit breaker is in "on" state as shown in FIG. 3, the slider 48 is moved in the direction of the arrow 70. Thus, the circuit breaker 37 is tripped from the "on" position as shown in FIG. 8. When, on the other hand, the circuit breaker 37 is in "off" state as shown in FIG. 5, the slider 48 is moved in the direction of the arrow 71, so that the circuit breaker 37 becomes the same state as shown in FIG. 7 where the circuit breaker 37 has been tripped from the "off" position. In this operation, whenever the slider 48 is moved in the above-described manner, the manual lever 57 is turned to swing the display board 60, so that the "trip" display part 60*b* appears in the display window 61.

When, in the case where the circuit breaker 37 is in "on" state as shown in FIG. 3, the manual operating shaft 56 is turned counterclockwise with the manual operating handle 62 fitted through the inserting hole 63 into the engaging hole 64, then the slider 48 is moved in the direction of the arrow 70 by the manual lever 57. Thus, the circuit breaker 37 can be turned off manually. When, in the case where the circuit breaker 37 is in "off" state as shown in FIG. 5, the manual operating shaft 56 is turned clockwise with the manual operating handle 62 fitted in the engaging hole 64 in the same manner, then the slider 48 is moved in the direction of the arrow 71 by the manual lever 57. Thus, the circuit breaker 37 can be manually turned on. In this manual operation, the slider 48 is free from the cam 44, and therefore only the circuit breaker handle 38 is operated. This means that the manual operation force is greatly reduced, and the manual operating section can be simplified in mechanism as much, which results in a reduction in manufacturing cost.

Figure 12A:
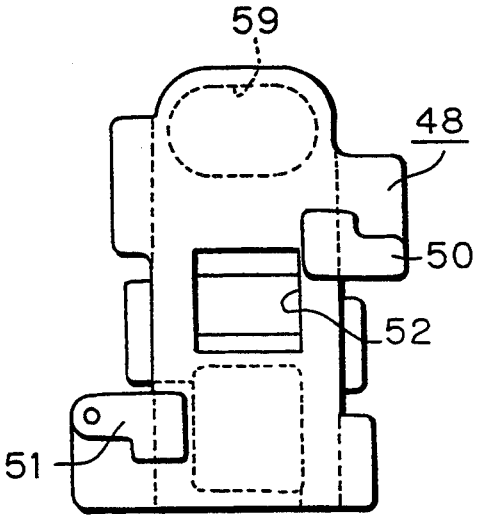
FIGS. 12(*a*) and 12(*b*) are schematic diagrams showing a slider.
Figure 12B:
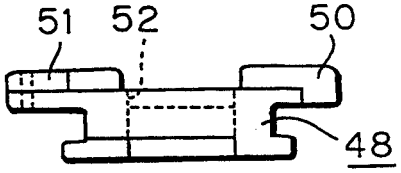
Figure 11:
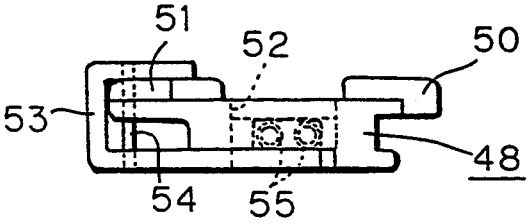
Figure 13A:
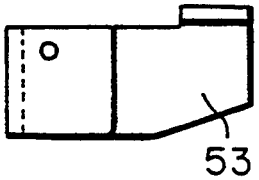
FIGS. 13(*a*) and (*b*) are schematic diagrams showing a reset lever in the device.
Figure 13B:
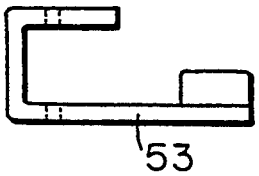
Figure 14:
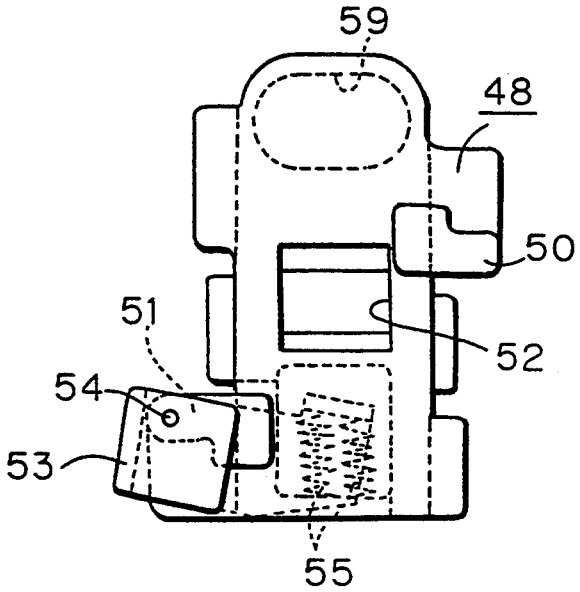
FIG. 14 is a schematic diagram, corresponding to FIG. 10, showing the reset lever being swung.
Figure 15:
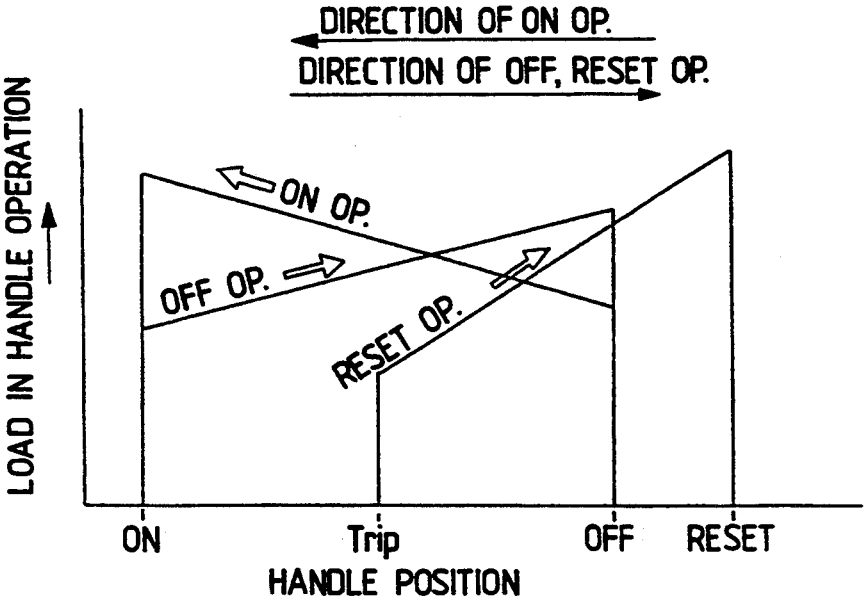
FIG. 15 is a graphical representation indicating operating load characteristics of the circuit breaker.

As shown in FIGS. 12(*a*) and 12(*b*), the cam engaging portions 50 and 51 of the slider 48 are positioned diagonally on the "on" operation side and the "off" operation side, respectively. With this arrangement, when the "on" or "off" operation is performed, the allowable range of stop positions of the electric motor (i.e., the distance which the cam roller 47 covers for the period of time which elapses from the time instant that the roller 47 leaves the "on"-operation-side cam engaging portion 50 until it abuts against the "off"-operation-side cam engaging portion 51) is wide enough. Hence, it is unnecessary to provide a brake or the like to stop the motor 43 (the latter 43 may be left as it is until it stops by itself).

By adjusting the positions of the cam engaging portions 50 and 51 of the slider 48, the characteristics of the operating stroke and the operating load can be matched with the characteristic of the operating load of the circuit breaker handle 38 of the circuit breaker 37. Accordingly, the electric motor 43 may be of small power.

When, to place in the "on" operation, the handle 38 is operated over its dead point, then the slider 48 is moved to the "on" position in association with the handle 38, which allows the common use of components for a circuit breaker whose handle 38 is somewhat different in operating stroke.

Figure 9:
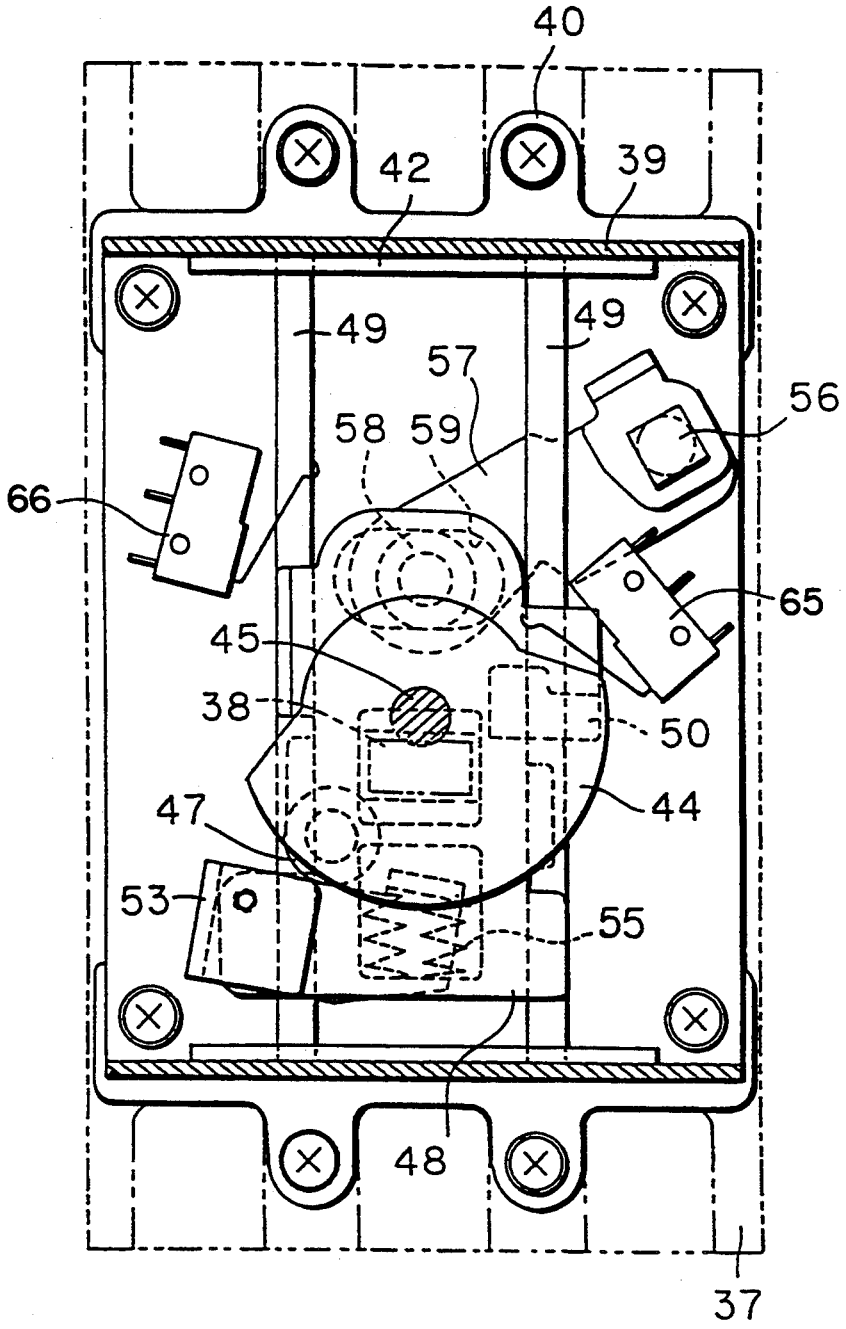
FIG. 9 is a schematic diagram illustrating a sectional view corresponding to FIG. 3, showing a state of the device when the circuit breaker is reset.
Figure 10:
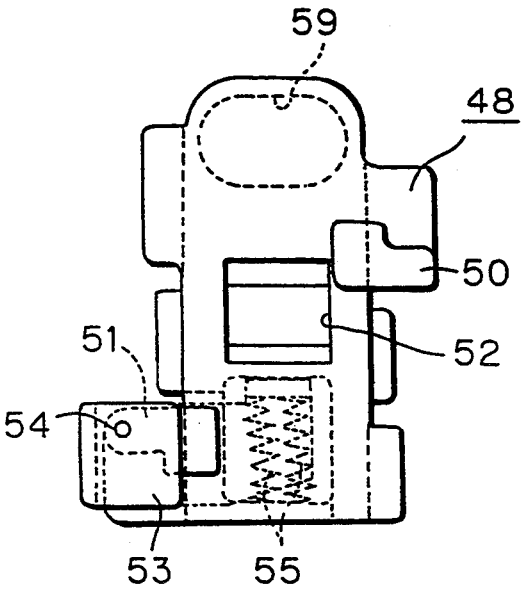
FIGS. 10 and 11 are schematic diagrams illustrating a front view and a bottom view of a slider section in the device, respectively.

When, in the case where the circuit breaker 37 in "on" state is tripped as shown in FIG. 8, the resetting operation is carried out to drive the motor 43, then the cam 44 is swung by 180° in the direction of the arrow 72. During this swinging operation, the cam roller 47 pushes the "off"-operation-side cam engaging portion 51 (and accordingly the reset lever 53) as shown in FIG. 9. Therefore, when the cam 44 is stopped at the "off"

position, the circuit breaker 37 is reset as shown in FIG. 5. While the circuit breaker is being reset as shown in FIG. 9, the cam roller 47 is shock-absorbed by the reset lever 53 turning against the compression spring 55. Therefore, the circuit breaker 37 less in reset margin can be positively reset. In other words, it is free from the difficulty that it cannot be reset for instance because of mounting errors. In addition, with the circuit breaker, the handle 38 will never be broken when reset.

The reset lever is rotatably mounted on the pin 54. Therefore, the compression spring 55 may be a weak one, which makes it possible to provide the reset lever in a small space.

Another embodiment of the invention will be described with reference to FIGS. 1 through 9 and FIGS. 16 through 18. As far as FIGS. 1 through 9 concern, the embodiment is substantially equal in arrangement to the above-described first embodiment. Therefore, the operation of the circuit breaker with the position detecting switch 65 provided for the cam 44 and with the position detecting switch 66 provided for the slider 48 will be described with reference to a motor control circuit shown in FIGS. 16 through 18.

Figure 16:
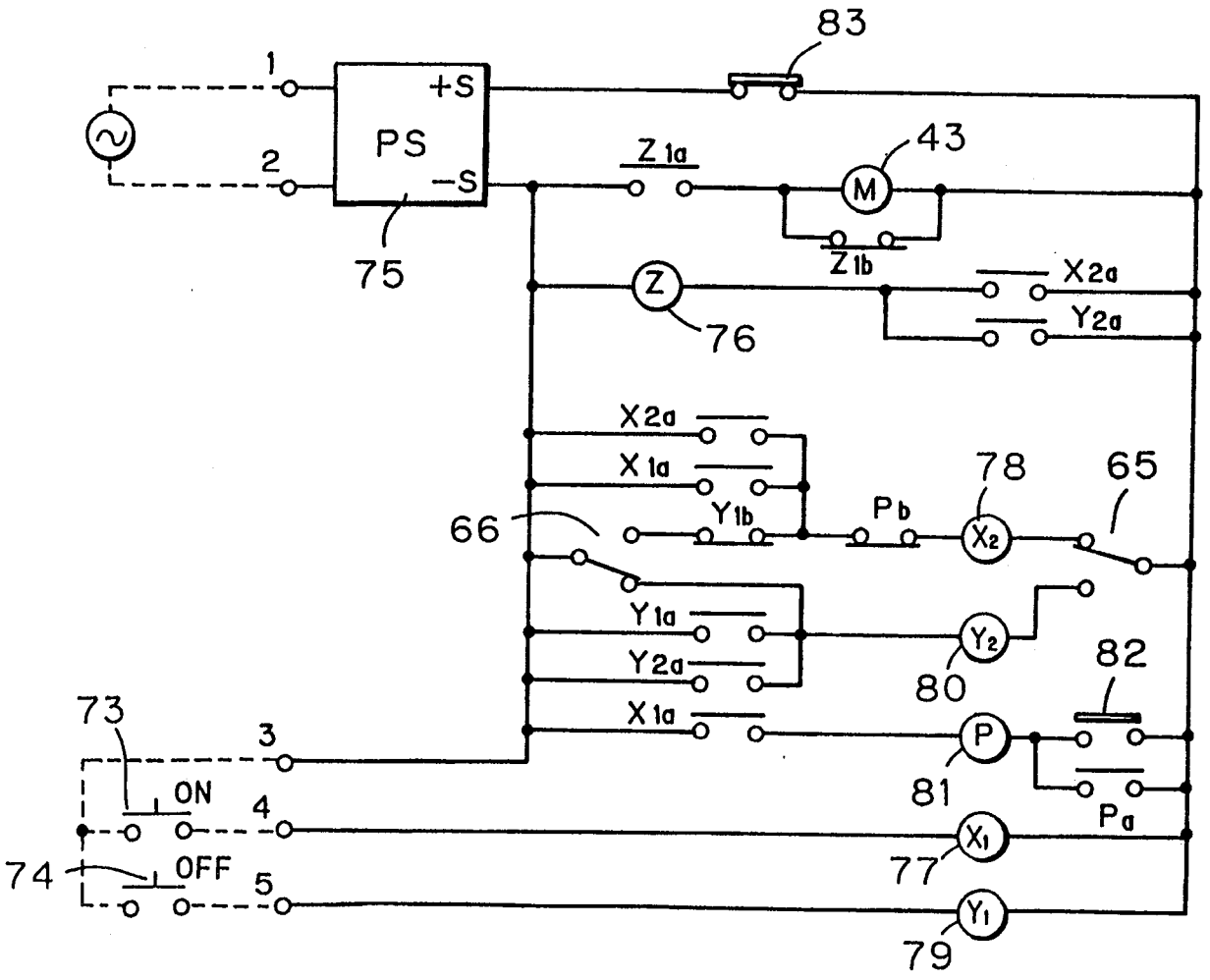
FIG. 16 is a connecting diagram showing a state of a motor control circuit when the circuit breaker is in "off" state.
Figure 17:
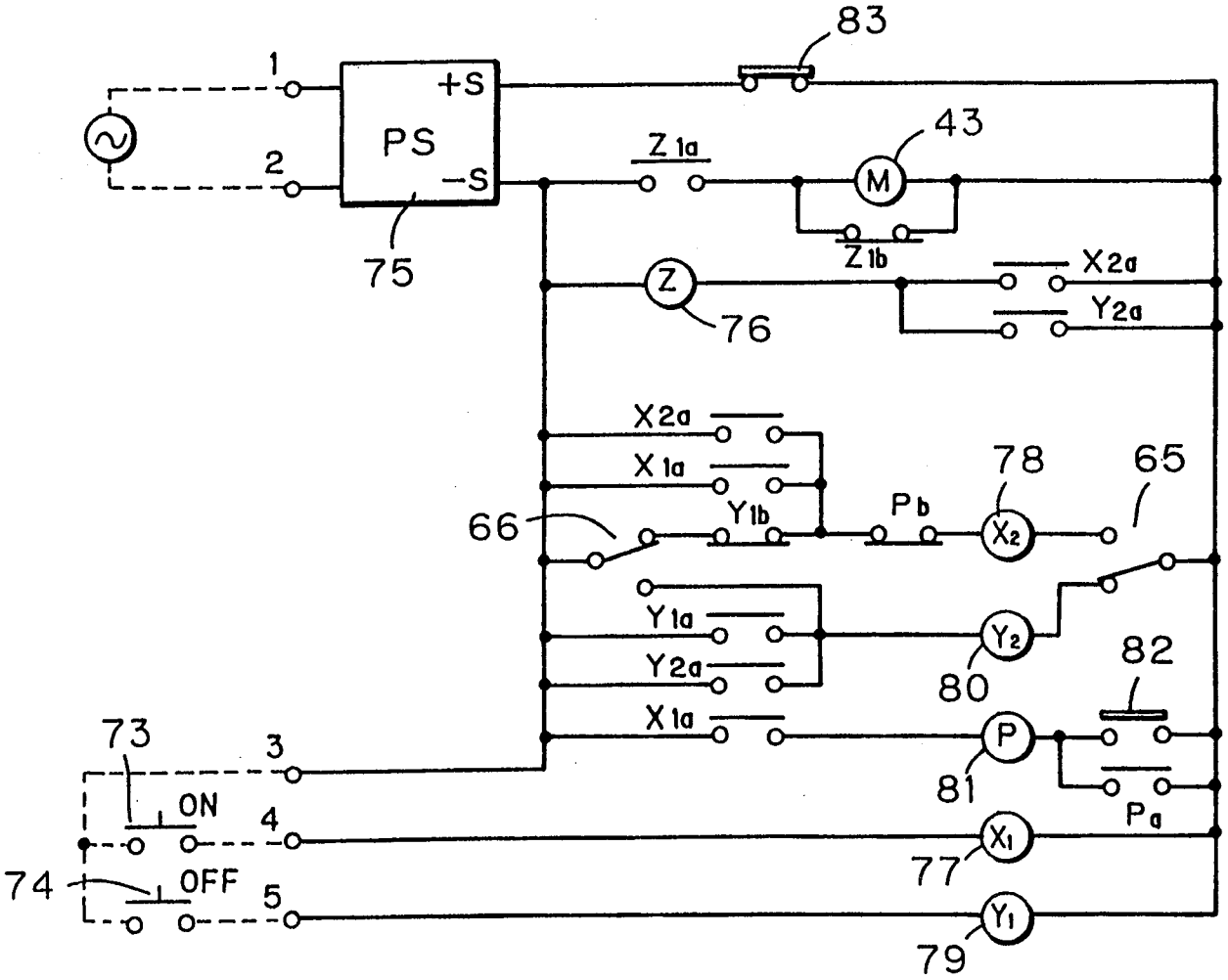
FIG. 17 is a connecting diagram showing another state of the motor control circuit when the motor control circuit when the circuit breaker is in "on" state.
Figure 18:
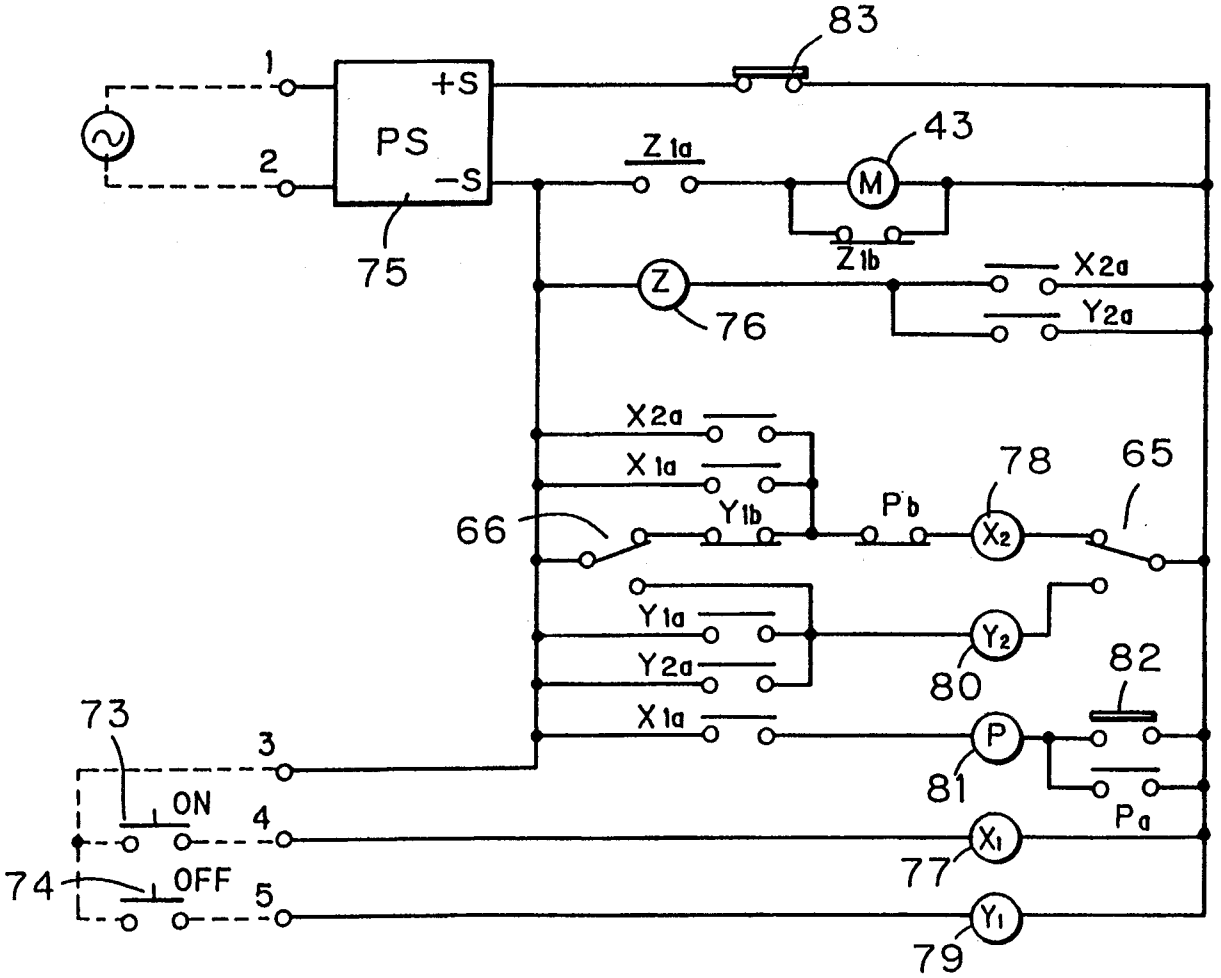
FIG. 18 is also a connecting diagram showing another state of the motor control circuit when the circuit breaker in "off" state has just tripped;.
Figure 19A:
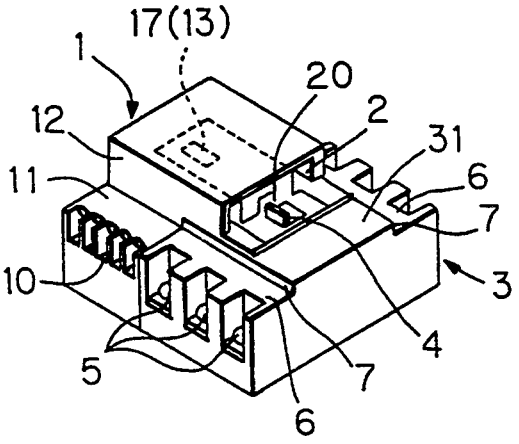
FIG. 19(a) (PRIOR ART)
FIGS. 19(*a*) through FIG. 19(*d*) are perspective views of a conventional electric operating device for a circuit breaker.
Figure 19B:
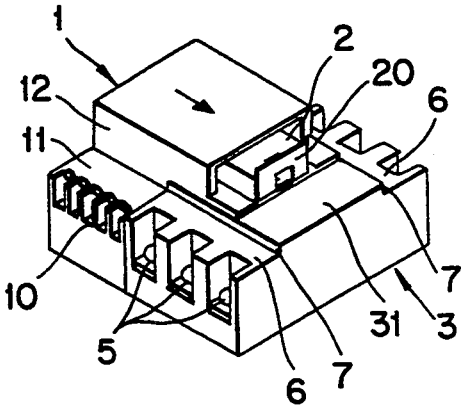
FIG. 19(b) (PRIOR ART)
Figure 19C:
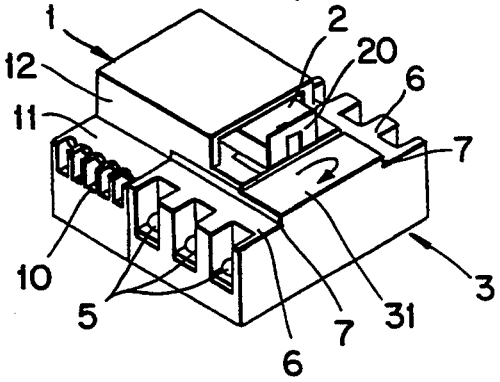
FIG. 19(c) (PRIOR ART)
Figure 19D:
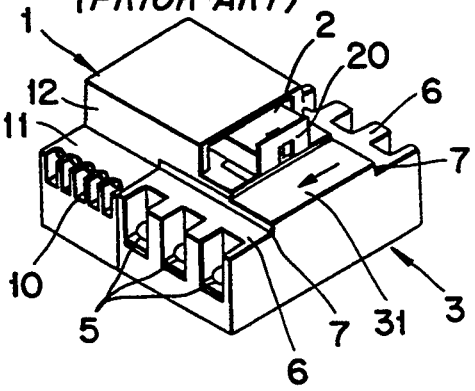
FIG. 19(d) (PRIOR ART)
Figure 20:
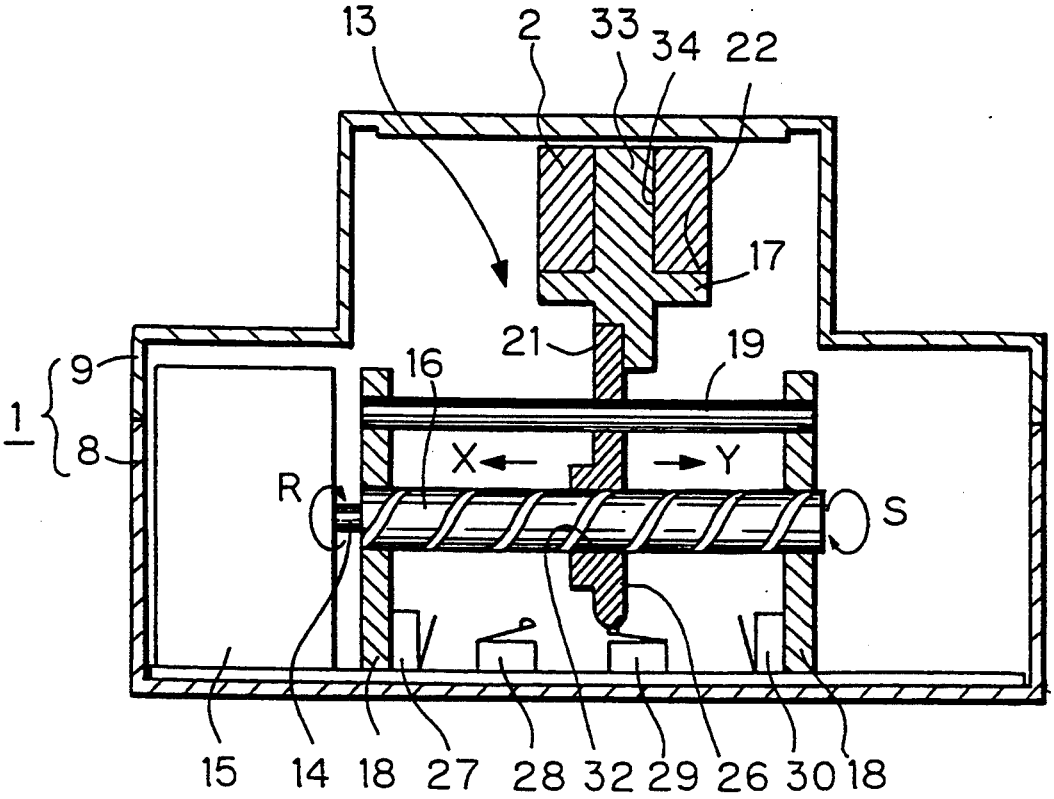
FIG. 20 (PRIOR ART)
FIG. 20 is a schematic diagram illustrating a sectional view of the conventional device.
Figure 21:
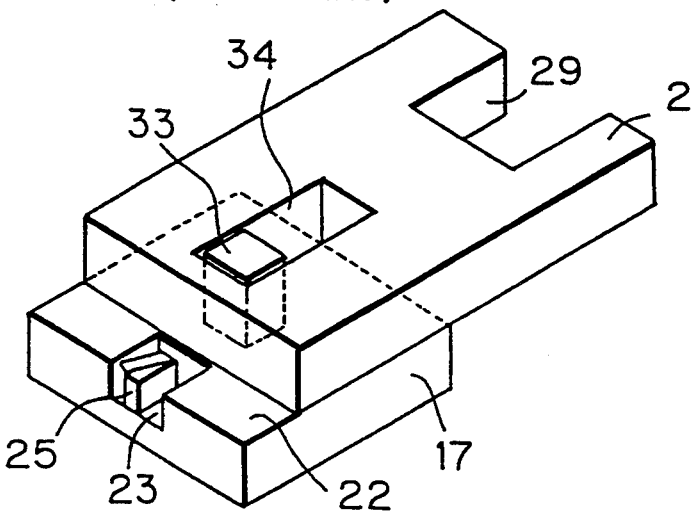
FIG. 21 (PRIOR ART)
FIG. 21 is an enlarged perspective view showing an operating member and a moving piece in the conventional device.
Figure 22:
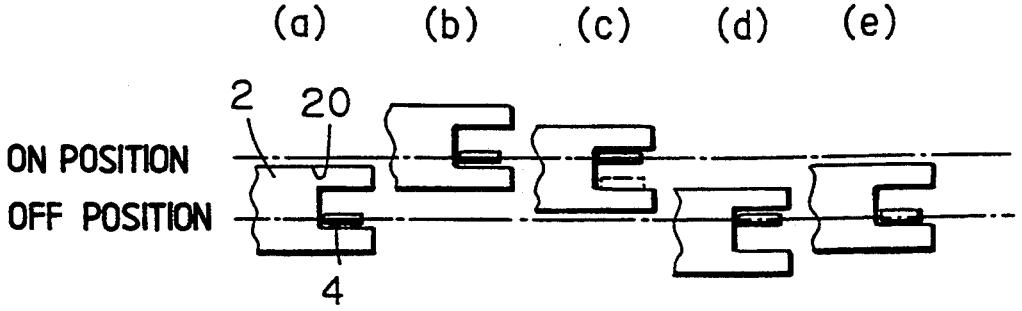
FIG. 22 (PRIOR ART)
FIG. 22 is an explanatory diagram for a description of the operation of the operating member in the conventional device.
Figure 23:
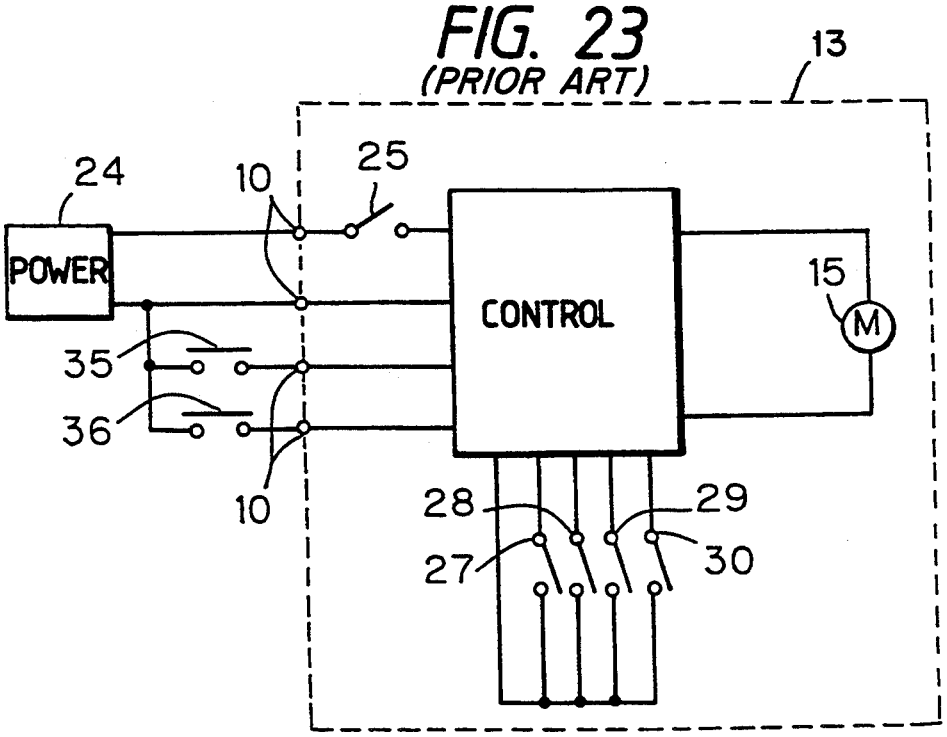
FIG. 23 (PRIOR ART)
FIG. 23 is a block diagram showing a control circuit for a drive section in the conventional device.

As was described before, FIG. 16 shows a state of the motor control circuit when the circuit breaker 37 is in "off" state (cf. FIG. 5), FIG. 17 shows another state of the motor control circuit when the circuit breaker 37 is in "on" state (cf. FIGS. 1 through 4), and FIG. 18 shows another state of the motor control circuit when the circuit breaker 37 in "off" state is tripped (cf. FIG. 7).

In those figures, reference numeral 73 designates an "on" operation switch; 74, an "off" operation switch; 75, a switching power source; 76, a motor controlling relay; 77 and 78, "on" operation relays; 79 and 80, "off" operation relays; 81, a pumping preventing relay; 82, a pumping preventing switch; and 83, a safety switch used for a manual operation.

When, in the case where the circuit breaker 37 is in "off" state as shown in FIG. 16, the "on" operation switch 73 is closed, the "on" operation relay 77, the "on" operation relay 78, and the motor controlling relay 76 are excited successively in this order, to rotate the electric motor 43. As a result, as was described before, the cam 44 is turned in the direction of the arrow 67 in FIG. 5, and the cam position detecting switch 65 is operated at the "on" position as shown in FIG. 3, thus suspending the application of exciting current to the "on" operation relay 78. Thereafter, the application of the exciting current to the motor controlling relay 76 is also suspended, and the motor 43 is then stopped. When the circuit breaker 37 is in "on" state, the slider position detecting switch 66 is operated by the slider 48 as shown in FIG. 3.

When, in the case where the circuit breaker 37 is in "on" state as shown in FIG. 17, the "off" operation switch 74 is closed, the "off" operation relay 79, the "off" operation relay 80, and the motor controlling relay 76 are excited successively in this order, to rotate the electric motor 43. As a result, as was described before, the cam 44 is turned in the direction of the arrow 69 in FIG. 3, and the cam position detecting switch 65 is operated at the "off" position as shown in FIG. 5, thus deenergizing the "off" operation relay 80 and the motor controlling relay 76. As a result, the motor 43 is stopped. When the circuit breaker 37 is in "off" state, the slider position detecting switch 66 is operated by the slider 48 as shown in FIG. 5.

When, as shown in FIG. 8, the circuit breaker in "on" state is tripped, the slider 48 is moved from the position shown in FIG. 3 to the position shown in FIG. 8 in association with the movement of the handle 38 of the circuit breaker 37 to the "trip" position, while the cam position detecting switch 65 and the slider position detecting switch 66 are held similarly as in the case where the circuit breaker is in "on" state. Therefore, the motor control circuit is held waiting for the "off" operation signal with the circuit breaker in "on" state as shown in FIG. 17.

When, as shown in FIG. 7, the circuit breaker in "off" state is tripped, the slider 48 is moved from the position shown in FIG. 5 to the position shown in FIG. 7 in association with the movement of the handle 38 of the circuit breaker 37 to the "trip" position. Therefore, in FIG. 16 with the circuit breaker in "off" state, the "on" operation relay 78 is excited, and then the motor controlling relay 76 is excited, so that the motor 43 is rotated. When, in the case where the circuit breaker in "off" state is tripped as shown in FIG. 7, the cam 44 makes substantially a half revolution in association with the rotation of the motor 43, and the cam position detecting switch 65 is turned on, so that the application of exciting current to the "on" operation relay 78 is suspended, and then the application of exciting current to the motor controlling relay 76 is also suspended. As a result, the motor 43 is stopped. The state that the circuit breaker in "on" state is tripped as shown in FIG. 8, and the state that the circuit breaker is in "on" state as shown in FIG. 17 are equal in that the circuit breaker is held waiting for the "off" operation signal.

When the handle 38 of the circuit breaker 37 is operated through the slider 48 by the operation of the manual operation handle 62, the slider position detecting switch 66 is operated. Therefore, when the manual "on" operation is performed with the circuit breaker in "off" state as shown in FIG. 16, the slide position detecting switch 66 is switched to a terminal which is other than the terminal shown in the figure. As a result, the "on" operation relay 78 and the motor controlling relay 76 are excited, so that the motor 43 is rotated. As the motor 43 rotates in this way, the cam 44 makes a half revolution, so that the cam position detecting switch 65 is operated, to stop the motor 43. Thus, the circuit breaker is placed in "on" state as shown in FIG. 17; that is, a position correcting operation (i.e., idling the cam in association with the manual "on" operation) has been accomplished. When the manual "off" operation is performed with the circuit breaker in "on" state as shown in FIG. 17, the slider position detecting switch 66 is switched to a terminal other than the terminal shown in the figure, so that the "off" operation relay 80 and the motor controlling relay 76 are excited to rotate the motor 43. As the motor 43 rotates in this way, the cam 44 makes a half revolution, so that the cam position detecting switch 65 is operated, to stop the motor 43. Thus, the circuit breaker is placed in "off" state as shown in FIG. 17; that is, a position correcting operation (i.e., idling the cam in association with the manual "off" operation) has been accomplished.

In the device, the slider, being set free from the cam, is moved to the "on", "off" and "trip" positions selectively in association with the movement of the circuit breaker handle. Therefore, the tripping of the circuit breaker handle can be displayed without requiring an intricate mechanism nor an additional space.

Furthermore, with such a device as described above, whether the circuit breaker is in "on" state, or in "off" state when tripped, it can be always reset by the "off" operation.

While there has been described in connection with the preferred embodiments of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. An electric operating device for a circuit breaker, comprising:

a cam which is turned in a predetermined direction by an electric motor which is driven by an operating signal;

a slider having cam engaging portions which make engagement and disengagement with a cam roller of said cam every half revolution of said cam, and an opening into which a handle of said circuit breaker is inserted, said slider being provided to be slidable in directions of the "on" and "off" operations of said handle, after the "on" and "off" operations of said handle, said cam engaging portions of said slider being disengaged from said cam roller, respectively.

2. The device as claimed in claim 1 wherein a manual lever operated by a manual operating lever is engaged with said slider.

3. The device as claimed in claim 1 wherein said cam engaging portions are provided on opposite ends and opposing sides of said slider corresponding to the "on" operation and the "off" operation, respectively so as to be positioned diagonally from one another.

4. The device as claimed in claim 2 wherein said cam engaging portions are provided on opposite ends and opposing sides of said slider corresponding to the "on" operation and the "off" operation, respectively, so as to be positioned diagonally from one another.

5. The device as claimed in claim 1 wherein said slider comprises a shock absorbing means for resetting said circuit breaker.

6. The device as claimed in claim 1 further comprising: a motor control circuit for driving said electric motor, said motor control circuit including a position detecting switch for said cam and a position detecting switch for said slider, each of which is a three-way switch.

* * * * *